US005469594A

United States Patent [19]

Nolte

[11] Patent Number: 5,469,594

[45] Date of Patent: Nov. 28, 1995

[54] CLEANING TOOL

[76] Inventor: Werner Nolte, Flurweg 2, D-55767 Nohen, Germany

[21] Appl. No.: 242,194

[22] Filed: May 13, 1994

[51] Int. Cl.[6] ..... A47L 1/06; A47L 1/15; A47L 13/12

[52] U.S. Cl. ..... 15/121; 15/105; 15/220.1

[58] Field of Search ..... 15/105, 121, 220.1

[56] References Cited

U.S. PATENT DOCUMENTS

| | | | |
|---|---|---|---|
| 629,835 | 8/1899 | Wertsbaugher | 15/121 |
| 3,395,415 | 8/1968 | Leland | 15/121 |
| 3,537,123 | 11/1970 | Leland | 15/121 |
| 4,152,807 | 5/1979 | Smahlik | 15/121 |
| 4,312,093 | 1/1982 | Raab | 15/121 |
| 4,910,825 | 3/1990 | Mauer | 15/121 |

FOREIGN PATENT DOCUMENTS

| | | | |
|---|---|---|---|
| 584387 | 10/1959 | Canada | 15/121 |
| 6809022 | 11/1968 | Germany | 15/121 |
| 2643717 | 8/1977 | Germany | 15/121 |
| 458618 | 7/1950 | Italy | 15/121 |

*Primary Examiner*—Timothy F. Simone
*Assistant Examiner*—Randall E. Chin
*Attorney, Agent, or Firm*—George W. Dishong

[57] ABSTRACT

A cleaning tool having a basic body which exhibits a handle and a holding device for the reception of a liquid-absorbing element for moistening an object to be wiped, most particularly a flat surface. The cleaning tool also has a mounting for a scraping element for sweeping the object in order to dry it, wherein the holding device is disposed between the mounting and the handle in such a way that, by changing the inclination of the basic body relative to the object, the latter can either be moistened or the moisture upon the object can be stripped off by the cleaning tool, and in a sweeping setting of the cleaning tool, the swept-off moisture being able to be absorbed by the liquid-absorbing element. The basic body may be pivotable relative to the handle from a first spring-loaded position into a second spring-loaded position. The scraping element may have two rubber lips. A wiping cloth, preferably having a cross section which is V-shaped, may be held by the holding device.

10 Claims, 2 Drawing Sheets

CLEANING TOOL

BACKGROUND OF THE INVENTION

1. Field of the Invention

This invention most generally relates to a cleaning tool which is useful for washing and drying objects such as flat surfaces. More particularly it relates to a cleaning tool for wiping, washing or cleaning of objects such as floors and windows. Even more particularly the invention relates to a cleaning tool which can be used to wipe and subsequently sweep or squeegee the flat surface without any substantial modification of the tool. Yet still more particularly the invention relates to the cleaning tool design such that wiping and squeegeeing may be accomplished simply by changing the angle of the handle of the tool by the user thereof.

2. Description of the Prior Art

Cleaning tools used in the cleaning, wiping or washing of smooth surfaces generally incorporate an absorbing element such as a sponge or absorbent cloth which absorb a cleaning liquid. The wetted or dampened sponge of the tool is then used to moisten and wipe the surface thereby cleaning it. In order to obtain a clear, reflective surface, the surface, after it is moistened and wiped, must then however, be dried. Drying is generally done by the surface being swept or squeegeed thus expelling the moisture or by using an appropriate element which would absorb the moisture on the flat surface.

Tools for moistening the object/surface to be wiped generally use a sponge which is steeped or dipped into the cleaning liquid, and the cleaning liquid, which can also be pure water, is distributed or spread over the object with the aid of the sponge.

The object can then be rubbed dry with a scraping element which absorbs the moisture, such as a leather cloth, or can be dried with the aid of a scraping tool which scraping tool has incorporated thereon a scraping element such as a squeegee which will expel the moisture. Particularly for windows and smooth surfaces the element which expels the moisture is well known and are generally identified as a squeegee. A squeegee is basically a rubber device which may be urged against the surface and when dragged over the surface the lip or the surface contacting edge of the squeegee forces the moisture to the edge of the surface where it can then drip therefrom.

Cleaning tools are known which are suitable both for moistening and for sweeping an object to be cleaned. These cleaning tools generally use a sponge or similar element for moistening purposes and can be dismantled and refitted replacing the sponge with a rubber lip or similar element i.e., a squeegee. Subsequent to moistening and after refitting the tool with a squeegee, the object moistening can then be swept i.e., squeegeed thereby removing the moisture from the object such as a pane of glass or window.

It would be desirable and advantageous to provide a universally usable cleaning tool with which objects such as floors and windows and especially smooth surfaces, can be easily wiped clean. It would also be most desirable to have such a cleaning tool which would both moisten and dry the surface without refitting the tool for each task. It would also be desirable if such a cleaning tool could, without the need to refit the tool, both squeegee and collect or absorb the moisture being swept-off or squeegeed thus not permitting such moisture to drip onto another surface. The cleaning tool herein described and defined achieves these desirable objective.

SUMMARY OF THE INVENTION

Basically the present invention in it's most simple form or embodiment is directed to a cleaning tool which is comprised of a basic body to which is attachable a handle, and to which is attached a holding device for receiving and holding a liquid-absorbing or moisture absorbing element, a clamping part which clamps a scraping element in a manner which situates the scraping element most distant from the handle and the liquid absorbing element and between the handle and the scraping element, the liquid-absorbing element configured to be assemble onto the holding device in a manner to expose one of preferably two surfaces of the liquid-absorbing element to an object to be cleaned when the cleaning tool is used. Also in the simplest embodiment, a change in the inclination of the basic body is achieved by the cleaning tool, with the handle, simply being held at a different angle.

The objective is achieved in the cleaning tool herein defined and described, by virtue of the fact that the cleaning tool has a holding device which situates the liquid-absorbing element between a basic body element and the squeegee or scraping element. A clamping part clamps the squeegee into position on the cleaning tool at a position most distant from the handle. The liquid-absorbing element is situated and held in place by a specially configured holder element in an attitude such that, by changing the inclination of the basic body relative to the object being cleaned, the object can either be moistened or the moisture upon the object stripped off by use of the squeegee. The liquid-absorbing element, preferably when it is substantially dry, may be used as a moisture-absorbing element in such a way where the swept-off or squeegeed moisture is swept or squeegeed directly to the moisture-absorbing element and there absorbed for removal.

The fact that the holding device for the liquid-absorbing element is provided, in the described manner, i.e., between the handle and the mounting for the scraping element, enables the object to be swept/squeegeed, without conversion of the cleaning tool. The basic body, put into a different inclination, resttits in lifting the liquid-absorbing element from the object while causing the scraping element which may be a squeegee to come into contact with the object.

Because of the particular design of the components of the cleaning tool and the spatial relationship between the components, the cleaning of objects such as windows is substantially facilitated especially where long poles are used to manipulate the cleaning tool because the cleaning tool does not have to be lowered for each phase of the cleaning operation.

It is important to again note that the cleaning tool can be held such that both the scraping element and the moisture-absorbing element are brought into contact with the object. If the object is swept with the cleaning tool inclined in this position, the cleaning tool being held such that the moisture-absorbing element lies in the direction of sweeping of the scraping element, then the swept-off moisture is absorbed by the moisture-absorbing element and cannot drip onto the floor or cause other typed of dirtying or marking.

A change in the inclination of the basic body can also however be accomplished by using a mechanism which tilts the basic body. This provides the advantage that the person operating the cleaning tool does not need to alter his or her grip or posture. Such a mechanism can comprise a spring-loaded balance, which supports the basic body and is held in each case in the desired end position, by means of the spring. By appropriate pressure of the cleaning tool against the object to be cleaned, the balance can be induced to snap over from one end position into the other. In an alternative embodiment, the balance can also be actuated by the operator by use of a Bowden cable or linkage.

A variable angle of inclination of the basic body can also be obtained by making the basic body hinge-fastened to the handle and being pivotable by means of a linkage or a Bowden cable, possibly spring-assisted.

The cleaning tool can also be used, without refitting, solely for moistening purposes or solely for scraping off liquid. The tool offers a very universal usage for the application of cleaning of objects which are substantially flat.

Another advantage of the invention is that the moisture-absorbing element can be removed easily from the tool so that the tool can be used as a pure squeegee or sweeping tool. The moisture-absorbing element can be easily washed out or replace. The moisture-absorbing element can be configured so as to have two sides or absorbing surfaces, one side of which faces outwardly (contactable with the object to be cleaned) and the other side is retained within the holding device. The moisture/liquid-absorbing element may be symmetrical making it reversible. That is it can be turned over thereby making the as yet unused surface available for liquid or moisture absorption.

A further refinement of the invention, is that the scraping element may have a scraping edge on both sides. That is there may be two edges configured so that the scraping element can be taken out of the clamping part turned over and reinsmiled into the cleaning tool using the second scraping edge to squeegee the moisture from the object being cleaned. Alternatively, the entire cleaning tool could be flipped over putting the basic body of the cleaning tool adjacent to the object being cleaned. In this method of use, only scraping, i.e., squeegeeing could be done.

It is obvious to those of ordinary skill that the scraping element may have several useful embodiments. It could have a V-shaped cross section The scraping element could also be rectangular having therefore, four (4) edges useful for scraping. Two (2) of the edges would be available for scraping and the other two edges could be seated in a holder which is then mountable and attachable to the tool. When two (2) edges become worn, the scraping element can be turned over so that the worn edges will be in the holder and the two (2) unused edges are available for sweeping off the moisture. For easier replacement, the holder could be replaceable as would be the scraping element.

A sponge may be used as the liquid-absorbing material, however, a wiping cloth has particular advantages. The wiping cloth is mounted on a holding device which is designed such that it may be U-shaped and a first side or surface of the liquid-absorbing element is firmly held by the geometry of both the holding device and the cloth absorbing element. The second side, which may be a mirror image of the first side, is available for cleaning or absorbing moisture as a consequence of scraping. Because of the symmetry of the absorbing cloth element, it can be easily turned over to expose for use the second surface or side. The surface adjacent to the holding device, i.e., the surface not available for cleaning is referred to as the inner side or surface. The surface exposed and available for use in cleaning and/or absorbing may be referred to as the outer surface or side.

The absorbing element as a wiping cloth may have a strong foundation fabric or material which would be substantially shape retaining. The cross-section may be essentially V-shaped. It would be advantageous to told or bend in the edges of the cloth so that no edges protrude from the basic body or from the cleaning tool itself.

The invention is explained in greater detail below with particular reference to the two illustrative embodiments. These and further objects of the present invention will become apparent to those skilled in the art after a study of the present disclosure of the invention and with reference to the accompanying drawings which are a part hereof, wherein like numerals refer to like parts throughout, and in which:

DESCRIPTION OF THE PREFERRED EMBODIMENTS

Figure 1:
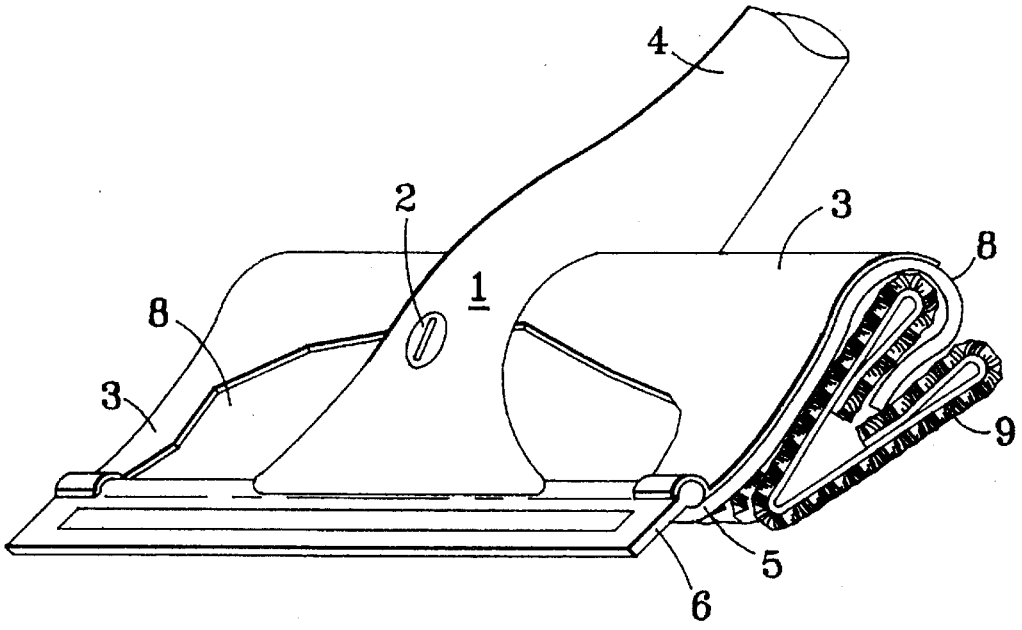
FIG. 1 shows a first embodiment obliquely from the front.

In FIG. 1, the basic body 1 is shown broken open in the middle. To the basic body 1 there may be fastened a handle (not shown) at gripping end 4 of basic body 1. At the end farther from the handle or gripping end 4 of basic body 1 there is a clamping edge 5C which compresses onto the top surface 3A of the clamping part 3. Clamping part 3 comprises a bent metal part. Clamping screw 2 is used to urge basic body 1, clamping part 3 and holder 8 together. At the foremost end, i.e., the farther end from the handle there is provided a groove which is created when clamping means 3 and holder 8 are assembled onto basic body 1. Recess 5A is located toward the farther end of clamping part 3 and recess 5B is located toward the further end of holder 8. Recess 5A and 5B when holder 8 and clamping part 3 are assembled to form groove 5 into which the rear, thickened end of a rubber lip is clamped for use as scraping element 6. Scraping element 6 and wiping cloth 9 are disposed such that window pane 14 can be swept and when positioned properly, that is when the cleaning tool is properly inclined the swept-off moisture is directly absorbed by the wiping cloth i.e., the moisture absorbing element 9.

Figure 2:
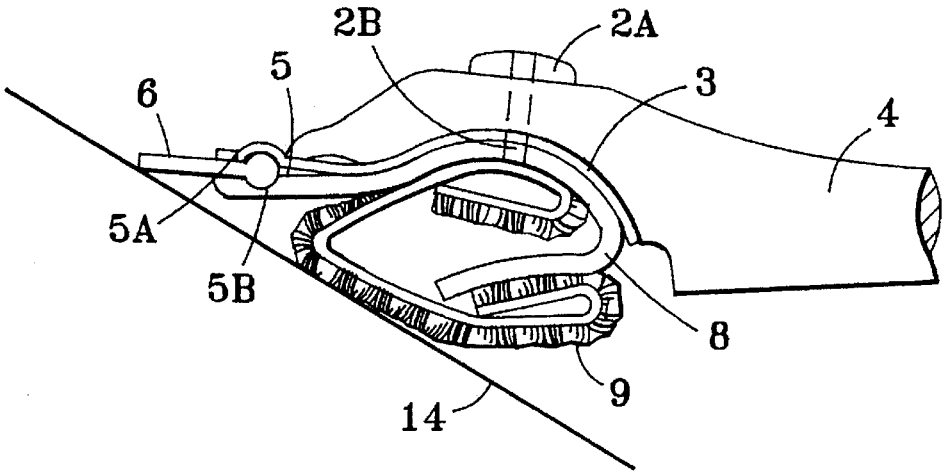
FIG. 2 is a side view of the first embodiment.
Figure 3:
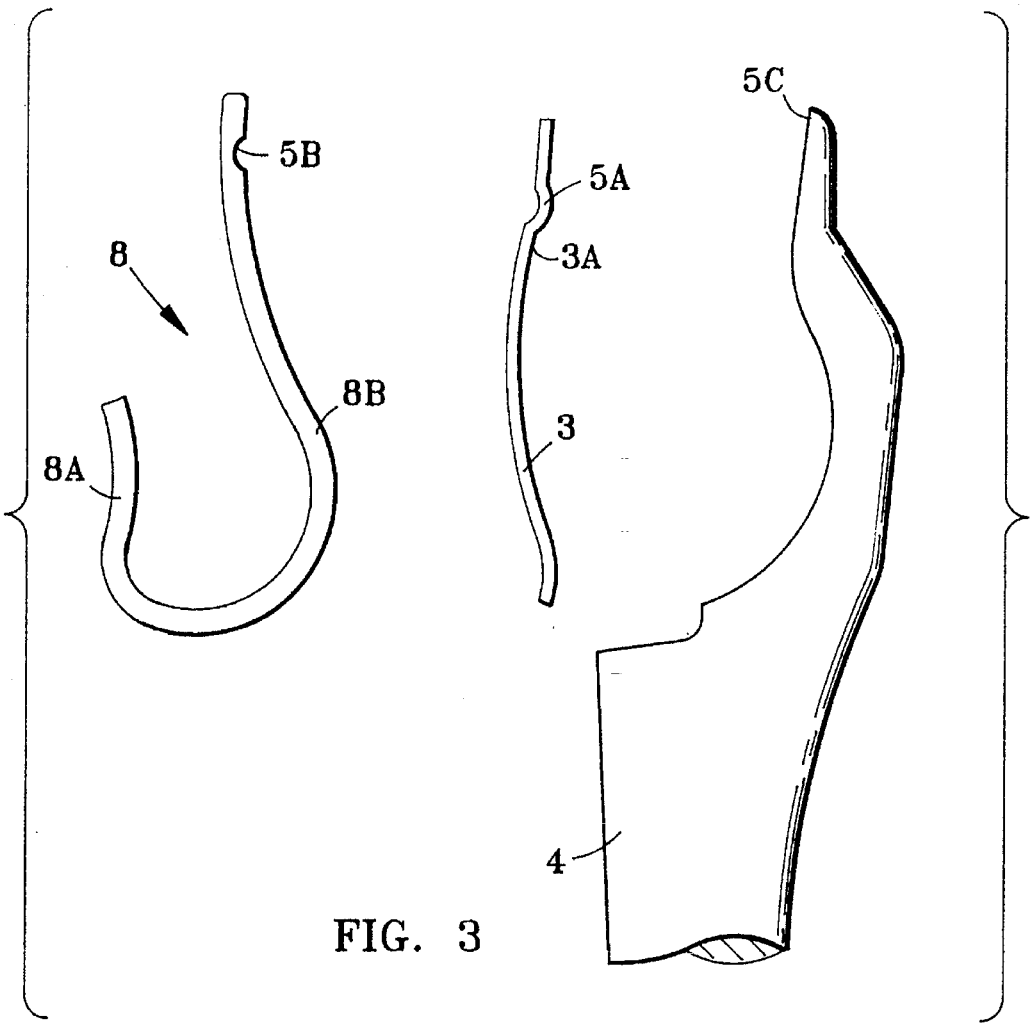
FIG. 3 illustrates separately each of the essential components of the first embodiment.

Basic body 1, clamping part 3 and holder 8 are represented individually in FIG. 3. Holder 8 is configured somewhat like a "U". Holder 8 has a clamp segment 8B and a bent segment 8A onto which wiping cloth 9 (see FIG. 2) can be mounted. Clamping part 3 is bent counter to the contour of basic body 1. If the elastic clamping part 3 is drawn by means of the clamping screw 2 into the contour of the basic body 1, an amount of spring tension is generated which compresses groove 5 thus ensuring a secure holding of scraping element 6 and further prevents clamping screw 2 from being easily unscrewed since the entire screw connection is under spring pressure. Clamping screw 2 has a threaded segment which attaches to or turns into a mating threaded hole located in holder 8. Alternatively, holder 8 may have incorporated thereon a threaded stud 2B inserted through basic body 1 and thus jutting out from basic body 1. A threaded nut 2A, which can be easily turned by hand which would tighten the component together. It is, however, also possible to use a clamping part, functionally equivalent to clamping part 3, which is matched to the contour of basic body 1. If such a configured clamping part and holder 8 have sufficient strength, scraping element 6 can be clamped tight and the basic body 1 screwed firmly in place without any bracing of the parts.

Figure 4:
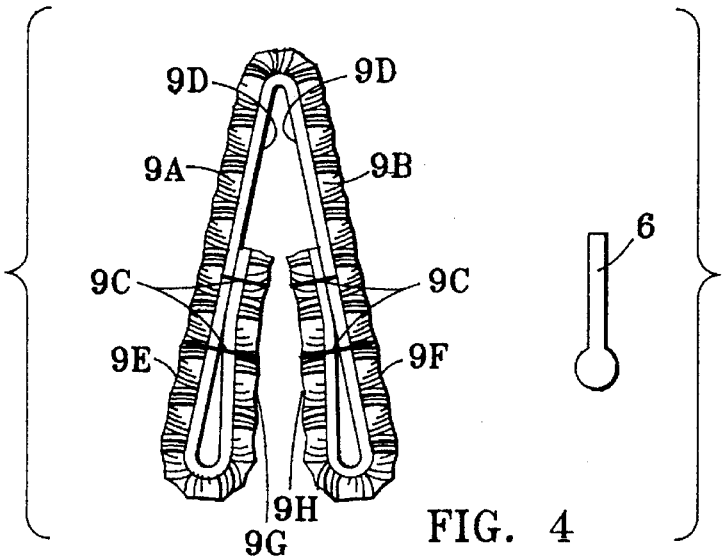
FIG. 4 illustrates in side views, both the cloth absorbing element and the squeegee or scraping element.

In FIG. 4, the V-shaped wiping cloth 9, having two (2) legs, one leg 9A and the other leg 9B, and scraping element 6 is represented individually. As can be clearly seen, wiping cloth 9 has inwardly bent end segments 9G and 9H. As can be clearly deduced from FIG. 2, this bending serves to prevent sharp edges which would lead to rapid wearing of wiping cloth 9 and might additionally, in some circumstances, damage the object to be cleaned. Wiping cloth 9 consists of a relatively strong foundation fabric 9D which supports the actual wiping bristles.

As can be clearly seen from FIG. 2, the V-shaped wiping cloth 9 is drawn up over the bent segment 8A of holder 8. For better fixing or securing or wiping cloth 9 to holder 8, wiping cloth 9 shown in FIGS. 1, 2 and 4 has ends of bent end segments 9G and 9H which are attached by stitching 9C to the respective middle regions of wiping cloth 9. One of bent end segments say 9G of wiping cloth 9 which envelop the bent segment 8A of holding device 8, connected by stitching 9C in such a manner so as to produce, to a certain extent, a pocket in which bent segment 8A of holder 8 is received. In the fitted or assembled state, bent segment 8A i.e., the lower portion of holder 8 forces the one leg 9A, which leg is the outer or usable leg of V-shaped wiping cloth 9, outwards or away from basic body 1 which ensures that wiping cloth 9 and particularly one leg 9A protrudes clearly from basic body 1 and can be easily brought into contact with surface 14 to be wiped. The other leg 9B is well protected from contamination by holder 8 when wiping cloth 9 is assembled onto holder element 8 and is held in compression contact with clamp segment 8B. Thus if one leg 9A becomes dirtied or worn, other leg 9B can be brought to the outside i.e., to the usable position, by simply turning over wiping cloth 9 i.e., by reverse mounting of wiping cloth 9 onto holder 8.

I claim:

1. Cleaning tool for cleaning objects which are substantially smooth and flat comprising:

a basic body having a handle end to which is attachable a handle, a portion configured to matingly accept a clamping part and a holding device, and means for removeably attaching the clamping pan and the holding device;

a wiping element having two sides, each side adapted for cleaning; a scraper element;

the holding device removeably attached to the basic body, further configured for receiving and holding the wiping element, the wiping element configured to be assembleable onto the holding device in a manner to expose one of the two sides of the wiping element to an object to be cleaned when the cleaning tool is used;

the clamping part removeably assembled, in combination with the holding device, onto the basic body portion, the clamping part comprising means for clamping the scraping element in a manner which situates the scraping element most distant from the handle, the wiping element situated between the handle and the scraping element wherein the holding device has a substantially U-shaped cross section comprising a bent segment and a clamp segment, the bottom of the U-shaped cross section is most proximate the handle end and further wherein the holding device receives the wiping element at an inner surface of the clamp segment of the holding device proximate the basic body and at an outer surface of the bent segment facing away from the basic body.

2. The cleaning tool according to claim 1, wherein the wiping element is a sponge.

3. The cleaning tool according to claim 2 wherein the sponge has a V-shaped cross section and configured for ultimately mounting any one of each of the two legs of the V-shape onto the holding device at an inner surface of the clamp segment of the holding device.

4. The cleaning tool according to claim 1, wherein the wiping element is a wiping cloth.

5. The cleaning tool according to claim 4, wherein the wiping cloth has a V-shaped cross section and configured for alternately mounting any one of each of the two legs of the V-shape onto the holding device at an inner surfaced the clamp segment of the holding device.

6. The cleaning tool according to claim 5, wherein the ends of the wiping cloth are inwardly folded.

7. The cleaning tool according to claim 6, wherein the ends of the wiping cloth are stitched to the respective middle segment of the wiping cloth.

8. The cleaning tool according to claim 4, wherein the ends of the wiping cloth are inwardly folded.

9. The cleaning tool according to claim 8, wherein the ends of the wiping cloth are stitched to a respective middle segment of the wiping cloth.

10. The cleaning tool according to claim 1, wherein the means for clamping a scraping element is a recess defined on the clamping part configured to cooperate with a cooperating recess on the holding device, which when assembled to the basic body forms a groove wherein a mounting end of the scraping element is clamped, and wherein the scraping element has a scraping end substantial parallel to the mounting end.

* * * * *